United States Patent [19]

Pitel

[11] 4,075,476

[45] Feb. 21, 1978

[54] SINUSOIDAL WAVE OSCILLATOR BALLAST CIRCUIT

[75] Inventor: Ira J. Pitel, Pittsburgh, Pa.

[73] Assignee: GTE Sylvania Incorporated, Stamford, Conn.

[21] Appl. No.: 752,167

[22] Filed: Dec. 20, 1976

[51] Int. Cl.[2] ..... H05B 37/02; H05B 39/04; H05B 41/36

[52] U.S. Cl. ..... 315/209 R; 315/DIG. 2; 315/DIG. 5; 315/239; 315/278; 315/205; 315/265; 315/97

[58] Field of Search ..... 315/DIG. 5, DIG. 7, 315/97, 209, 274, 220, 233, 219, 257, 212, 266, 265, 260, 239, 257, 278, 297, 205, 112, 113; 331/113 A

[56] References Cited

U.S. PATENT DOCUMENTS

| | | | |
|---|---|---|---|
| 3,754,160 | 8/1973 | Jensen | 315/DIG. 7 |
| 3,769,545 | 10/1973 | Crane | 315/219 |
| 4,045,711 | 8/1977 | Pitel | 315/265 |

*Primary Examiner*—Alfred E. Smith

*Assistant Examiner*—David K. Moore

*Attorney, Agent, or Firm*—Norman J. O'Malley; Thomas H. Buffton; Robert T. Orner

[57] ABSTRACT

A sinusoidal wave oscillator ballast circuit includes a tuned oscillator coupled to a DC rectifier means coupled by a power factor correction circuit to an AC potential source. The oscillator is coupled to an inductor means including a first and second transformer means with the secondary winding of the first transformer means coupled to the oscillator, the primary of the first transformer means in series connection with a capacitor and the primary winding of the second transformer means to form a resonant circuit, a first secondary winding of the second transformer means coupled to a lamp circuit to form a load circuit shunting the capacitor of the resonant circuit and a second secondary winding of the second transformer means having opposite ends connected by clamping diodes to the DC rectifier means. Means for compensating for "storage time" of the transistor of the oscillator and for conditioning the line to transients and radio frequency interference (RFI) are also provided.

10 Claims, 5 Drawing Figures

SINUSOIDAL WAVE OSCILLATOR BALLAST CIRCUIT

CROSS-REFERENCE TO OTHER APPLICATIONS

A co-pending application bearing U.S. Ser. No. 668,485, and now U.S. Pat. No. 4,045,711 entitled "Tuned Oscillator Ballast Circuit", filed Mar. 19, 1976 in the name of the inventor of the present application and assigned to the assignee of the present application relates to a tuned oscillator type of ballast circuit having a plurality of inductive windings associated with an oscillator to effect development of a resonant circuit, activation of the oscillator, coupling to a load circuit, and clamping of the circuitry to inhibit uncontrolled current flow through the oscillator.

BACKGROUND OF THE INVENTION

This invention relates to sinusoidal wave oscillator ballast circuits and especially to such circuitry suitable for use with fluorescent lamps of the 35 to 40 watt variety.

Presently manufactured ballast circuits for fluorescent lamps are, most frequently, of the 120 Hz auto-transformer type. Therein, the saturation characteristic of the transformer is employed to provide the desired currents necessary to the operation of a fluorescent lamp.

However, the auto-transformer type of ballast is known to be relatively heavy and cumbersome. Also, it is known that such apparatus is relatively inefficient which leads to excessive heat generation as well as energy loss. Moreover, the operational capabilities are something less than desired in view of the relatively low operational frequency of 120 Hz which is well within the audible range.

Another known form of lamp ballast circuitry employs a flip-flop type oscillator circuit in cooperation with a saturable core transformer. A transistor of the oscillator saturates and effects saturation of the core material of the transformer to limit current flow and inhibit lamp burnout. However, core material saturation characteristics are relatively erratic and unpredictable which renders such circuitry undesirable or at best, most difficult to accurately predict or control.

In still another form of lamp ballast circuitry, a rectangular-shaped waveform is developed and applied to a filter network. Therein, the rectangular waveform is converted to a sinusoidal waveform. However, rectangular-shaped waveform circuitry has been found less efficient than circuitry wherein a sinusoidal waveform is developed directly. Also, the required filtering to provide a sinusoidal waveform derived from a developed rectangular-shaped waveform is undesirably expensive.

A further form of lamp ballast apparatus is set forth in the previously-mentioned application entitled "Tuned Oscillator Ballast Circuit" filed in the name of the present inventor. As mentioned, the circuitry relates to a tuned oscillator having a plurality of inductive windings to effect development of resonance at a given frequency, activation of the oscillator coupled to a lamp circuit, and clamping of the circuitry to inhibit uncontrolled current flow through the oscillator.

Additionally, the prior art provided separate circuits for both transient signals and radio frequency interference (RFI). Moreover, the known transient filter circuits included either a single or "stacked" transient responsive devices while the RFI circuits included at least two inductors and a bifilar wound transformer. Such circuitry is relatively expensive and appears to leave much to be desired.

OBJECTS AND SUMMARY OF THE INVENTION

An object of the present invention is to provide an enhanced ballast circuit suitable for use with a lamp load. Another object of the invention is to provide an improved ballast circuit which minimizes power transients during transistor switching. Still another object of the invention is to provide an improved ballast circuit having cooperative acting multiple transformer inductive windings suitable to the development of protective potentials in response to open circuited load conditions. A still further object of the invention is to provide an improved ballast circuit having a power factor correction capability.

These and other objects, advantages and capabilities are achieved in one aspect of the invention by a ballast circuit having a tuned oscillator coupled to a DC rectifier means connected by a power factor correction circuit to an AC potential source. A first transformer includes windings connected to the oscillator and to a winding of a second transformer in series with a capacitor to form a resonant circuit. A load circuit shunts the capacitor of the resonant circuit. The second transformer includes a winding associated with a clamping circuit coupled to the DC rectifier means while the first transformer includes associated circuitry for effecting a transistor storage time correction capability. Moreover, power line conditioning circuitry is also provided.

DESCRIPTION OF THE PREFERRED EMBODIMENTS

For a better understanding of the present invention, together with other and further objects, advantages and capabilities thereof, reference is made to the following disclosure and appended claims in conjunction with the accompanying drawings.

Figure 1:
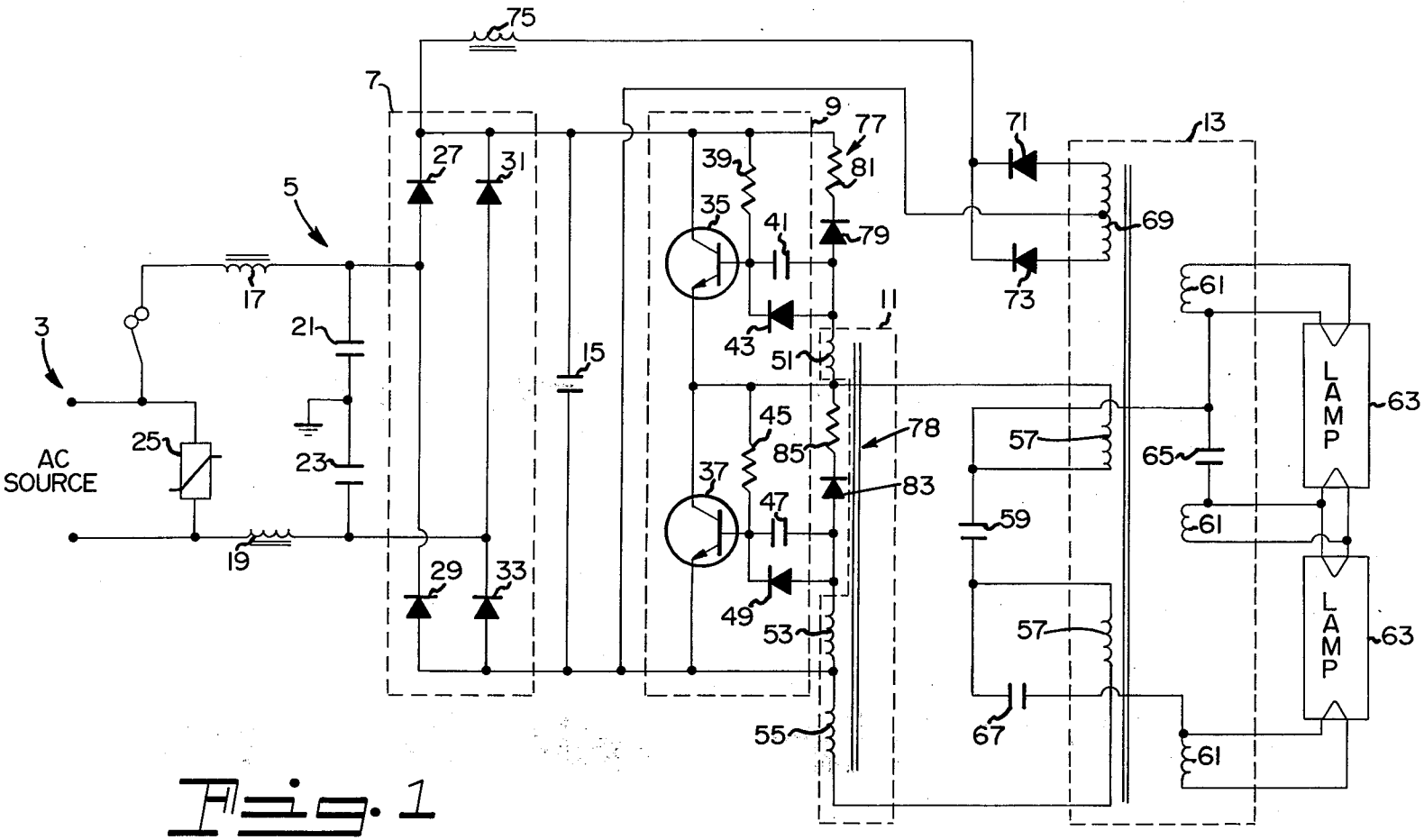
FIG. 1 illustrates a preferred embodiment of a sinusoidal wave tuned oscillator ballast circuit having power factor correction and transistor storage time correction capability.

Referring to FIG. 1 of the drawings, a sinusoidal wave oscillator ballast circuit includes an AC potential source 3 coupled by a power line conditioner and power factor correction circuit 5 to a DC rectifier means 7. A sinusoidal wave oscillator 9 is coupled to the DC rectifier means 7 and associated with a first transformer means 11 and to a second transformer means 13.

More specifically, the power line conditioner and power factor correction circuit 5 includes a power factor correction circuit portion having a capacitor 15 shunting the DC rectifier means 7 and a first inductor 17 coupling the DC rectifier means 7 to the AC potential source 3. The power line conditioner portion of the power line conditioner and power factor correction circuit 5 includes the first inductor 17 loosely coupled to a second inductor 19 with each one of the first and second inductors, 17 and 19 respectively, coupling one side of the AC potential source 3 to the DC rectifier means 7. Also, the junction of the DC rectifier means 7 and each one of the first and second inductors, 17 and 19, is coupled by first and second capacitors 21 and 23 to a potential reference level or circuit ground. Moreover, a transient suppressor 25, in this example, is shunted across the AC potential source 3.

The DC rectifier means 7 includes first, second, third, and fourth diodes, 27, 29, 31, and 33 respectively, in a bridge configuration. The junction of the first and second diodes 27 and 29 is coupled to the first inductor 17 and first capacitor 21 of the power line conditioner and power factor correction circuit 5. Similarly, the junction of the third and fourth diodes 31 and 33 is coupled to the second inductive means 19 and second capacitor 23 to power line conditioner and power factor correction circuit 5.

The sinusoidal wave oscillator 9 includes first and second transistors 35 and 37 series connected across the DC rectifier means 7. The first transistor 35 has a bias circuit coupled to the base thereof and includes a resistor 39 coupling the base to the collector and a parallel coupled capacitor 41 and diode 43 coupled to the base. The second transistor 37 also has a bias circuit including a resistor 45 coupling the base to the collector with a parallel connected capacitor 47 and diode 49 coupled to the base.

The first transformer means 11 includes a split secondary winding having a first portion 51 coupled to the emitter and to the parallel connected capacitor 41 and diode 43 coupled to the base of the first transistor 35. A second portion 53 of the secondary winding is coupled to the emitter and to the parallel connected capacitor 47 and diode 49 connected to the base of the second transistor 37. The primary winding 55 of the first transformer means 11 is directly connected to the primary winding 57 of the second transformer means 13.

The second transformer means 13 includes the split primary winding 57 in series connection with a charge storage means or capacitor 59 and the primary winding 55 of the first transformer means 11. A first secondary winding 61 of the second transformer means 13 is connected to a load in the form of a pair of lamps 63 and coupled by a pair of capacitors 65 and 67, in shunting relationship across the capacitor 59 of the series resonant circuit.

A second secondary winding 69 of the second transformer means 13 has a center tap coupled to the DC rectifier means 7. The outer ends of the second secondary winding 69 are each coupled to a diode, 71 and 73 respectively, which are coupled by an impedance 75 to the DC rectifier means 7.

Additionally, circuits 77 and 78 for effecting storage time of the first and second transistors 35 and 37 include a series connected diode 79 and resistor 81 and 83 and 85 respectively. The circuit 77 is coupled intermediate the capacitor 41 and diode 43 at the base of the first transistor 35 and the collector of the first transistor 35 and the circuit 78 is coupled intermediate the capacitor 47 and diode 49 at the base of the second transistor 37 and the collector of the second transistor 37. Other circuitry that compensates for storage time is also appropriate as will be explained hereinafter.

Figure 2:
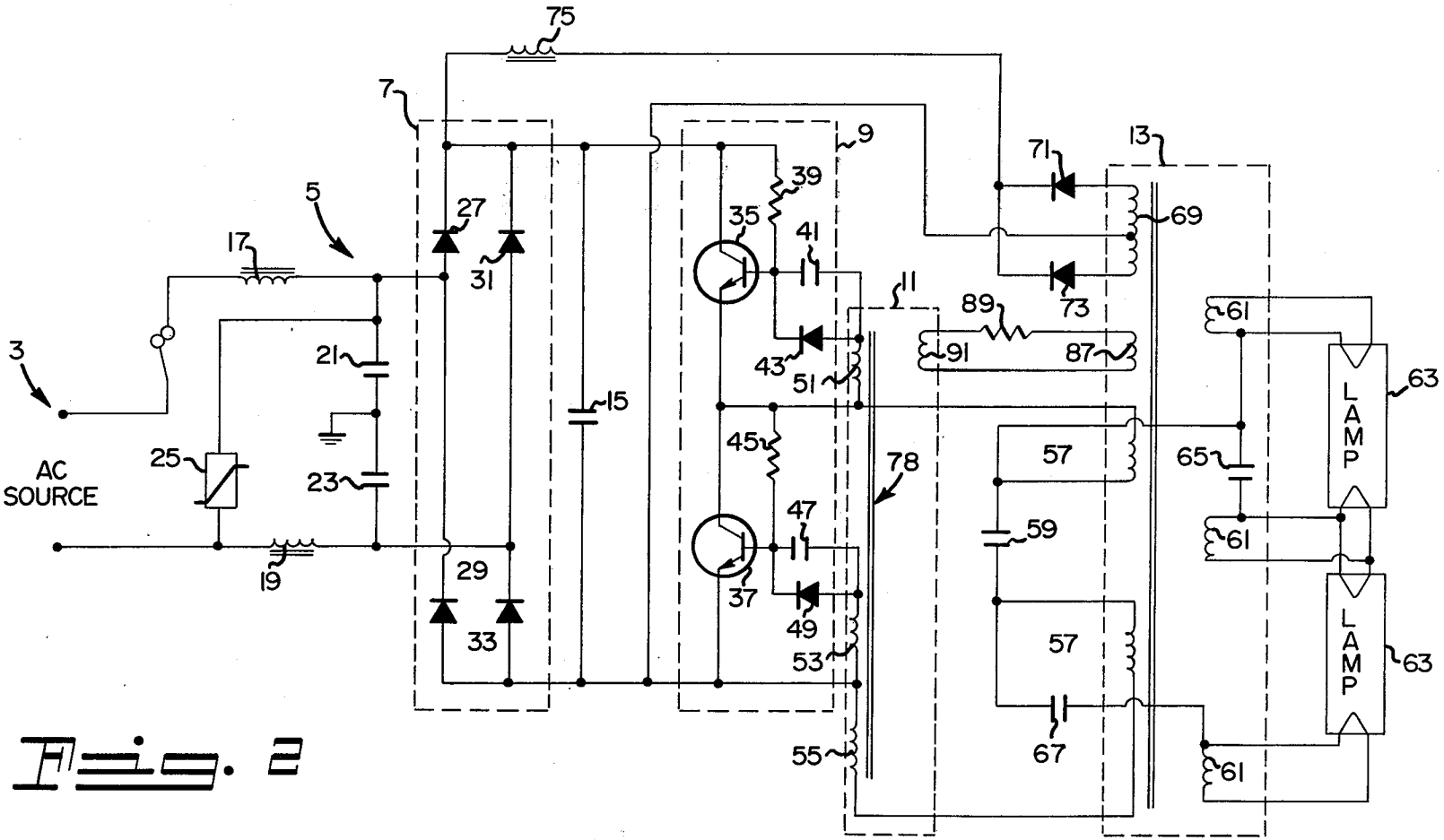
FIG. 2 is an alternate embodiment of a sinusoidal wave tuned oscillator circuit employing power factor and storage time correction circuitry.

An alternate embodiment of the ballast circuitry of FIG. 1 is illustrated in FIG. 2. Therein, the configurations are substantially similar and bear the same numerals except for the power line conditioner and power factor correction circuit 5, the sinusoidal wave oscillator 9, and the first and second transformer means 11 and 13 respectively.

In the power line conditioner and power factor correction circuit 5 of FIG. 2, the transient suppressor 25 is coupled to the junction of first inductor 17 and first capacitor 21 and to the junction of the AC potential source 3 and second inductor 19. Obviously, the coupling is reversible in that the transient suppressor 25 could be coupled to the junction of the AC potential source 3 and first inductor 17 and the junction of the second inductor 19 and second capacitor 23.

Also, the second transformer means 13 has an added secondary winding 87 in series connection with an impedance, illustrated as a resistor 89, and an added primary winding 91 on the first transformer means 11. Thus, circuitry is provided for an alternate method of "storage time" compensation, as will be explained hereinafter, and the circuits 77 and 78 of FIG. 1 are not employed.

As to operation of the power line conditioner and power factor correction circuit 5, the power line conditioner includes the first and second inductors 17 and 19 mutually coupled and connecting the AC potential source 3 to the DC rectifier means 7 and via first and second capacitors 21 and 23 to circuit ground with a transient suppressor means 25 either shunting the AC potential source 3, illustrated in FIG. 1, or coupling one side of the AC potential source 3 to the junction of the opposite side of the AC line and the DC rectifier means 7 as in FIG. 2.

The power line conditioner serves as both a transient and as a radio frequency interference (RFI) filter. In the preferred embodiment, illustrated in FIG. 2, an undesired transient response at the AC potential source 3 is subjected to a two-stage filtering process. The transient suppressor means 25 serves to "clip" the undesired transient signal and serves as an active filter. Thereafter, the "clipped" response is further filtered by a second or passive low-pass filter in the form of one of the first and second inductors 17 and 19 and the load circuit.

Moreover, this double-filtering network permits the use of relatively inexpensive transient suppressor devices 25 having a less rigid "knee" characteristic capability. More specifically, the prior known single filter transient response networks required a relatively sharp "knee" characteristic because of the large change in potential applied thereto when a transient signal occurred. However, the double filtering technique of the above-mentioned circuits permits utilization of less expensive transient response devices with less critical "knee" characteristics since the transient is both clipped and filtered.

Also, the first inductor and capacitor, 17 and 21 respectively, and the second inductor and capacitor, 19 and 23 respectively, each serve as low pass filters to inhibit RFI signals appearing at the AC potential source 3 from getting to the load or DC rectifier means 7.

The first and second inductors 17 and 19 also appear as a high impedance for signals directed toward the AC potential source 3. Thus, the AC potential source 3 and DC rectifier are isolated with respect to RFI signals by the power line conditioner 5 therebetween.

Further, the first and second inductors 17 and 19 are loosely coupled therebetween. In this manner, currents tending to flow in the circuitry of the first inductor 17 are cancelled by equal and opposite currents flowing in the circuitry of the second inductor 19. As a result, the mutual coupling of the first and second inductors 17 and 19 serves to cancel any unbalance in current flow and inhibit any flow of currents to the ground circuit of the apparatus.

As to operation of the sinusoidal wave oscillator ballast circuit, a pulsed DC potential at a frequency of 120 Hz is applied to the oscillator means 9. The oscillator means 9 is coupled to a series resonant circuit which includes the primary winding 55 of the first transformer 11, the primary winding 57 of the second transformer 13, and the capacitor 59. Also, this oscillator means 9 is operable and the circuitry resonant at a frequency of about 33 KHz.

The load circuit which includes the lamps 63 and secondary winding 61 of the second transformer is shunted across the capacitor 59 by means of the capacitors 65 and 67. Initially, a major portion of the current flowing in the oscillator means 9 passes through the resonant circuit having a relatively low impedance while the parallel connected lamps appear as a relatively high impedance which inhibit current flow therethrough. As the lamps become ionized, an increasing amount of the current flows therethrough while the current flowing through the resonant circuit decreases. Thus, the Q of the tank circuit is reduced when the available current is utilized by the lamps load.

It may be assumed that load lamps 63 appear as an open circuit. Thereupon, current flow through the primary winding 57 of the second transformer 13 would increase. In turn, the voltage developed across the primary winding 57 increases which induces an increased potential across the secondary winding 69 of the second transformer means 13. The increased potential on the secondary winding 69 causes conduction of the diodes 71 and 73 which provide clamping of the voltage appearing across the transistors, 35 and 37, and the primary winding 57 at some given value. Thus, the transistors 35 and 37 are protected from injurious increased current flow even though an open circuit condition of the load lamps 63 occurs.

Also, it is well known that transistors have a characteristic known as storage time which may be defined as the time required to remove excess minority carriers stored in the base of a transistor. In other words, a finite time is required to remove the excess minority carriers in the base circuit whenever switching of a transistor is to be effected.

Figure 3:
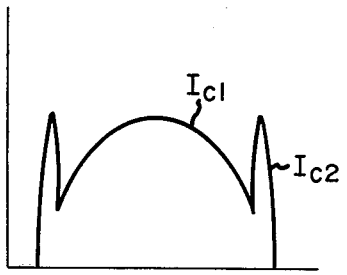
FIG. 3 is a graphic illustration of currents in each transistor of a sinusoidal wave oscillator lacking proper storage time correction circuitry.

Previously, the known forms of ballast switching circuitry made no provision for switching trajectory optimization. As a result, it was common practice in inverter circuits to have both high collector current and collector to emitter voltage during switching transitions as illustrated in FIG. 3. The collector current $I_{c1}$ of one transistor has super-imposed thereon an additional collector current $I_{c2}$ from a second transistor due to the lack of compensation for storage time of the transistor. Thus, both transistors conduct when the switching transition occurs.

As a result of the above-illustrated relatively high values of collector current occurring during switching transitions, it has been a common practice to employ transistors having high transient power capability. The switching trajectory of this load line is graphically illustrated by curve A of FIG. 4.

Figure 4:
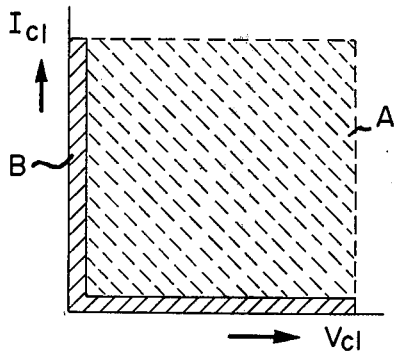
FIG. 4 is a current-voltage graphic illustration of transistors having "L" shaped and inductive-load type switching trajectories.

However, circuitry designed to provide compensation for storage time permits utilization of transistors having an "L"-shaped, low power transient, switching trajector which may be graphically illustrated as curve B of FIG. 4. Thus, storage time compensation permits the utilization of relatively inexpensive, and fast switching transistors.

Figure 5:
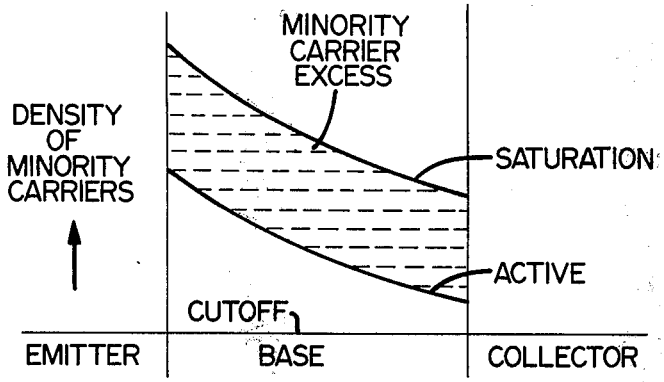
FIG. 5 is a graphic illustration of the density of minority carriers in the base region of a transistor.

As to storage time compensation, one technique provides a circuitry for reducing the excess minority carriers prior to switching the transistor by altering the conductivity of the transistor from a "saturation" region to an "active" region. As illustrated by the diagram of FIG. 5, appearing on page 259 of a McGraw-Hill publication entitled "Electronic Devices and Circuits" copyright 1967, an excess of minority carriers is present in the base region between a "saturation" condition and an "active" condition.

Additionally, an "active" condition refers to an operational condition of the transistor whereat the base to collector junction is reverse biased. Thus, reducing the excess minority carriers to substantially zero by going to an "active" condition prior to switching substantially eliminates the storage time problem and permits utilization of a transistor with low power transient capability.

Referring to the circuitry of FIG. 1, it can be seen that each one of the transistors 35 and 37 has associated therewith a circuit 77 and 79 which includes a series connected diode 79 and resistor 81 and diode 83 and resistor 85. Each one of the circuits 77 and 79 act in the form of a clamping circuit to cause each one of the switching transistors 35 and 37 to enter an "active" condition prior to switching. In other words, as each one of the transistors 35 and 37 approaches a switching condition, current in the base circuit is reduced by the circuits 77 and 79 in an amount sufficient to cause the collector voltage to substantially equal the base voltage. Thus, an "active" condition is achieved, the excess minority carriers are reduced to substantially zero, storage time is reduced, and switching occurs at essentially zero collector current value.

Another technique for effecting "storage time" is illustrated in the embodiment of FIG. 2. Therein the same current flows through the primary windings 55 and 57 of the first and second transformer means 11 and 13 respectively. The secondary winding 87 of the second transformer means 13 has a 90° phase shift in the voltage with respect to the current in the primary windings 57. Thus, the current flowing through the secondary winding 87, resistor 89, and primary winding 91 of transformer means 11 is phase shifted to provide a current leading the current through the primary windings 55 and 57 by 90°.

In turn, this 90° leading current present in the primary winding 91 is vectorially combined with the currents flowing in the secondary windings 51 and 53 of the first transformer means 11. This combined current flow provides a resultant flow of current to the base of the transistors 35 and 37 which leads the collector current by a phase angle pre-selected by values of the windings and primarily the resistor 89.

As a result, the current applied to the base of the transistors 35 and 37 is phase adjusted to lead the collector current by an amount sufficient to compensate for the storage time of the transistor. Thus, the transistors 35 and 37 are switched during zero collector current, which allows the use of inexpensive transistors.

Thus, there has been provided a unique sinusoidal wave oscillator ballast circuit especially suitable for use with 35 and 40 watt fluorescent lamps. The apparatus is light in weight, uses inexpensive components, efficient, and provides an operating capability which is believed to be unattainable with any other known circuitry. Also, the apparatus includes circuitry whereby inexpensive but efficient transistors are suitably utilized and compensation for open circuit conditions of the load circuit are provided.

While there has been shown and described what is at present considered preferred embodiments of the invention, it will be obvious to those skilled in the art that various changes and modifications may be made therein without departing from the invention as defined by the appended claims.

What is claimed is:

1. A sinusoidal wave oscillator ballast circuit comprising:

an AC potential source;

a DC rectifier means;

a power factor corrector circuit means coupled to said AC potential source and to said DC rectifier means;

oscillator means including a pair of series connected transistors shunting said DC rectifier means;

a first transformer having a primary and secondary windings, said secondary winding of said first transformer directly coupled to said oscillator means;

a second transformer having a primary winding and a first and second secondary winding, said primary windings of said first and second transformers in series connection with a capacitor to form a resonant circuit shunted across said oscillator means, said first secondary winding of said second transformer coupled to lamp circuitry to form a load circuit in shunt connection across said capacitor of said resonant circuit and said second secondary winding of said second transformer connected by a pair of diodes to said DC rectifier means to effect clamping thereof at a given potential level whereby said given potential level is maintained despite open circuiting of said load circuit; and circuit means coupled to said oscillator means for effecting correction for storage time of said transistors of said oscillator means.

2. The sinusoidal wave oscillator ballast circuit of claim 1 wherein said circuit means for effecting correction for storage time of said transistors of said oscillator means is in the form of a series connected second primary winding of said first transformer means, an impedance, and a third secondary winding of said second transformer means to effect a phase shift of current of said transistor of said oscillator means and cause said base current to lead said collector current to compensate for storage time of said transistors.

3. The sinusoidal wave oscillator ballast circuit of claim 1 wherein said circuit means for effecting correction for storage time of said transistors of said oscillator means is in the form of a series connected uni-directional conduction device and impedance coupling said secondary winding of said first transformer to an output electrode of each one of said transistors of said oscillator means whereby said transistors operate from a saturation to an active region of conduction prior to switching from a conductive state to a non-conductive state.

4. The sinusoidal wave oscillator ballast circuit of claim 1 wherein said power factor correction circuit is in the form of a capacitor shunting said DC rectifier means and an inductor coupling said DC rectifier means to said AC potential source.

5. The sinusoidal wave oscillator ballast circuit of claim 1 including a power line conditioner means coupled to said AC potential source and to said pulsed DC rectifier means, said power line conditioner means including a first and a second capacitor each coupled to said pulsed DC rectifier means and to a potential reference level, first and second inductor means each coupled to said pulsed DC rectifier means and to one of said first and second capacitors and to said AC potential source and having a mutual inductance therebetween, and a transient suppressor means shunting said AC potential source.

6. The sinusoidal wave oscillator ballast circuit of claim 1 wherein said transient suppressor means is coupled to the junction of said AC source and one of said inductor means and the junction of one of said capacitors and the other of said first and second inductor means.

7. A sinusoidal oscillator ballast circuit comprising:

an AC potential source;

a pulsed DC rectifier means;

a power line conditioner and power factor corrector circuit means coupled to said AC potential source and to said pulsed DC rectifier means;

oscillator means having a pair of series connected transistors shunting said pulsed DC potential source;

first and second transformer means with said first transformer means having a primary and secondary winding and said second transformer means having a primary and first and second secondary windings;

said primary windings of said first and second transformer means in series connection with a capacitor to form a resonant circuit shunting said oscillator means;

said secondary winding of said first transformer means directly coupled to said oscillator means;

said first secondary winding of said second transformer means in series with a lamp circuit shunting said capacitor of said resonant circuit; and said second secondary winding of said second transformer means having center tap coupled to said pulsed DC rectifier means with each of the outer ends of said second secondary winding connected to a diode coupled to said pulsed DC rectifier means.

8. The sinusoidal wave oscillator ballast circuit of claim 7 wherein said power factor corrector of said power line conditioner and power factor corrector circuit means includes a capacitor shunting said pulsed DC rectifier means and an inductor coupling said pulsed DC rectifier means to said AC potential source.

9. The sinusoidal wave oscillator ballast circuit of claim 7 wherein said power line conditioner of said power line conditioner and power factor corrector circuit means includes first and second capacitors each coupled to said pulsed DC rectifier means and to a potential reference level, first and second inductive means coupled to said first and second capacitors respectively, and to said AC potential source with a mutual coupling therebetween, and a transient suppressor shunting said AC potential source.

10. The sinusoidal wave oscillator ballast circuit of claim 7 wherein said second transformer means includes a third secondary winding in series connection with an impedance and a second primary winding of said first transformer means for effecting a phase shift in current applied to said oscillator means to compensate for storage time of said oscillator means and effect switching thereof at a substantially zero current level whereby switching losses are minimized.

* * * * *